US005535921A

United States Patent [19]

Gelman et al.

[11] Patent Number: 5,535,921

[45] Date of Patent: Jul. 16, 1996

[54] SAMPLE DISPENSER

[75] Inventors: Zeev Gelman, Hadera; Gideon Gelman, Petach Tikva; Boris Kotlarsky, Hadera, all of Israel

[73] Assignee: New Dimension Products Ltd., Hefer, Israel

[21] Appl. No.: 296,288

[22] Filed: Aug. 25, 1994

[51] Int. Cl.[6] ..... B67D 5/00

[52] U.S. Cl. ..... 222/78; 40/419; 222/52; 222/167; 222/192

[58] Field of Search ..... 222/39, 52, 63, 222/78, 166, 167, 144.5, 333, 504, 526, 192; 239/211; 446/475; 40/411, 414, 419, 455, 906; 472/133, 137; 221/24

[56] References Cited

U.S. PATENT DOCUMENTS

| | | | |
|---|---|---|---|
| 714,553 | 11/1902 | Armstrong | 221/24 |
| 1,493,102 | 5/1924 | Campbell | 40/419 |
| 2,633,651 | 4/1953 | Nelson et al. | 40/419 X |
| 3,434,628 | 3/1969 | Ceraldi | 222/52 |
| 3,802,606 | 4/1974 | Gust | 222/504 X |
| 4,454,670 | 6/1984 | Bachmann et al. | 40/584 |
| 4,891,660 | 1/1990 | Biondo, Jr. | 354/412 |

*Primary Examiner*—Kevin P. Shaver
*Attorney, Agent, or Firm*—Mark M. Friedman

[57] ABSTRACT

A sample dispenser for dispensing a sample of a product. The dispenser includes a dispensing apparatus for dispensing the sample where the dispensing apparatus is displaceable between a stand-by position and a dispensing position in which the dispensing apparatus dispenses the sample. The dispenser also includes motorized driving apparatus for selectively driving the dispensing apparatus between its stand-by position and its dispensing position and user controlled activation apparatus for actuating the driving apparatus.

18 Claims, 3 Drawing Sheets

SAMPLE DISPENSER

FIELD AND BACKGROUND OF THE INVENTION

The present invention relates to sample dispensers in general and in particular to sample dispensers having an outward artistic and ornamental appearance in the form of a human body and one or more movable appendages, such as arms and legs, which may be manipulated for dispensing a sample of a product.

Various designs of sample dispensers having an outward artistic and ornamental appearance are known in the art.

For example, U.S. Pat. No. 1,694,959 to Ament describes an atomizer in the form of an ornamental figure such as a toe dancer standing with one leg upright upon a pillow while the other leg is substantially horizontal with its foot being inclined backward toward the upstanding leg and with an aperture at its knee. The aspirator of the atomizer is concealed within the leg upon which the figure stands while the spray tube of the atomizer is concealed within the substantially horizontal leg such that a sample of perfume can be dispensed through the aperture from a reservoir within the pillow.

Other designs of sample dispensers having an outward artistic and ornamental appearance include one or more movable appendages which may be manipulated for dispensing a sample of a product.

For example, U.S. Pat. No. 1,767,911 to Berko et al. describes an atomizer in the form of a doll having one or more movable appendages, such as the arms and legs constituting parts of the doll, which may be manipulated to cause atomization of a perfume, the spray issuing from one or more orifices in portions of the doll, such as its mouth, eyes, nose, etc. While U.S. Pat. No. 4,982,874 to Pringle describes a shampoo dispenser container in the form of an action figure, such as an army figure, having a fluid pumping system that operates to dispense shampoo from the container in an exploding type pattern as one of the arms of the action figure is operated in a combat type movement. And while U.S. Pat. No. 5,172,863 to Melone et al. describes a dispenser for fluids including a doll body having a pair of pivotally mounted wings thereon, a dispensing assembly in the doll body and a linkage mechanism which is responsive to the pivotal movement of the wings for dispensing fluid from an aperture.

Although the above and similar designs have had limited success, they suffer from the disadvantage that they lack realism by failing to imitate the motion of a consumer, a sales assistant, a waitress and the like dispensing a sample of a product.

There is therefore a need for a sample dispenser having an outward artistic and ornamental appearance which imitates the motion of a consumer, a sales assistant, a waitress and the like dispensing a sample of a product. In particular, there is a need for a sample dispenser for dispensing a sample of a cosmetic product onto the back of the hand of a consumer such that the sample can be readily smelled by the consumer.

SUMMARY OF THE INVENTION

The present invention is for a sample dispenser having an outward artistic and ornamental appearance which imitates the motion of an arm of a consumer, a sales assistant, a waitress and the like dispensing a sample of a product. In particular, the present invention is for a sample dispenser for dispensing a sample of a product onto the back of the hand of a consumer such that the sample can be readily smelled by the consumer.

Hence, there is provided according to the teachings of the present invention, a sample dispenser for dispensing a sample of a product, the sample dispenser comprising: (a) dispensing means for dispensing the sample, the dispensing means displaceable between a stand-by position and a dispensing position, the dispensing means dispensing the sample when deployed in the dispensing position; (b) motorized driving means for selectively driving the dispensing means between the stand-by position and the dispensing position; and (c) user controlled activation means for actuating the motorized driving means.

According to further features of the present invention, the dispensing means rotates between a substantially upright position and a substantially horizontal position.

According to still further features of the present invention, the dispensing means is deployed over the user controlled activation means when the dispensing means is deployed in the dispensing position.

According to still further features of the present invention, the dispensing means substantially overlies said user controlled activation means when said dispensing means is deployed in said dispensing position.

According to yet still further features of the present invention, the user controlled activation means is a depressible device or a sensor.

According to yet still further features of the present invention, the dispenser includes selection means for enabling a user to select a sample from a plurality of products.

According to yet still further features of the present invention, the dispenser includes speech delivery means for delivering a sales pitch associated with the sample.

According to yet still further features of the present invention, the dispenser includes display means for displaying a storage container of the product.

According to yet still further features of the present invention, the sample dispenser is configured as at least a portion of a mannequin.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a sample dispenser for dispensing a sample of a product. The product can be from a wide range of consumer goods including cosmetics, beverages, comestible products and the like.

The principles and operation of the sample dispenser according to the present invention may be better understood with reference to the drawings and the accompanying description.

Figure 1:
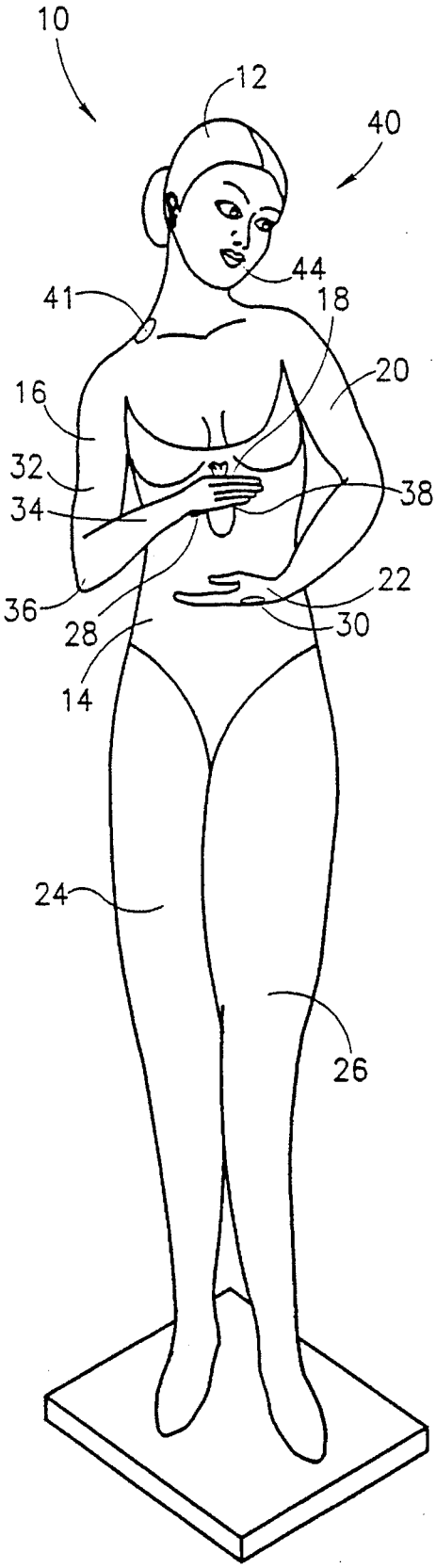
FIGS. 1 and 2 are schematic illustrations of a preferred embodiment of a sample dispenser having a movable appendage for dispensing a sample of product, constructed and operative according to the teachings of the present invention, in which the movable appendage is in its stand-by position and in its dispensing position, respectively.
Figure 2:
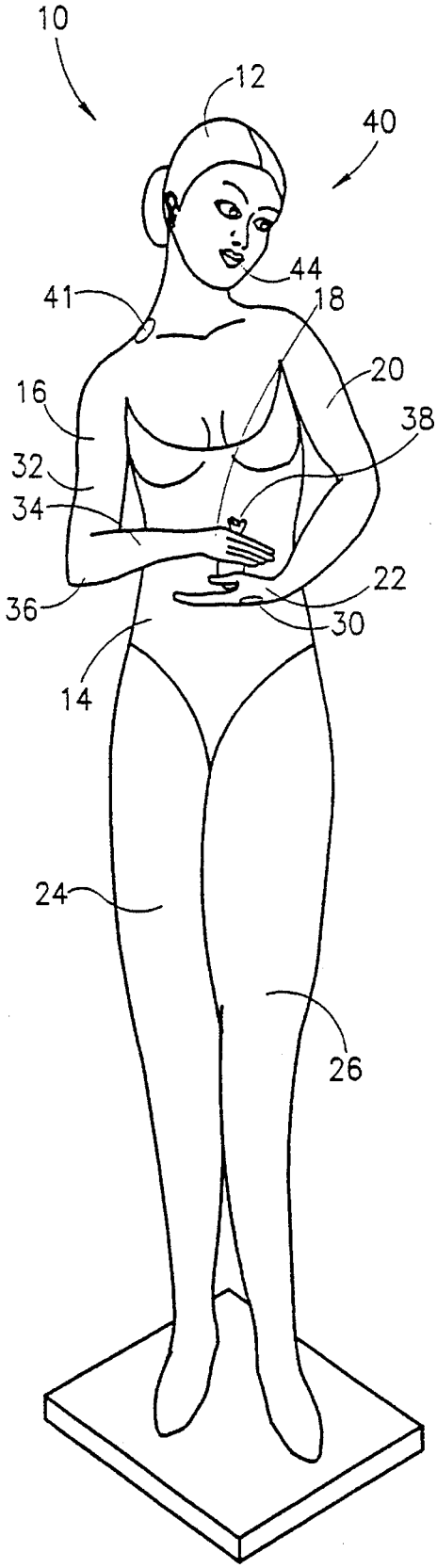

Referring now to the drawings, FIGS. 1 and 2 show a sample dispenser, generally designated 10, constructed and operative according to the teachings of the present invention, for dispensing a sample of a product. The product can be from a wide range of consumer goods including, but not limited to, cosmetics, beverages, comestible products and the like. Typical cosmetics include liquid cosmetics such as perfumes, paste cosmetics such as hand cream, powder cosmetics, and the like. Typical beverages can include beer, fruit juice, and the like. Typical comestibles can include confectioneries and the like.

Sample dispenser 10 is preferably in the form of a mannequin. Mannequin 10 can be a full body human figure including a head 12 mounted on a trunk section 14, a right arm 16 terminating in a right hand 18, a left arm 20 terminating in a left hand 22, a right leg 24 and a left leg 26. However, it is sufficient for the purpose of the present invention that mannequin 10 includes head 12, trunk section 14, right arm 16, right hand 18, left arm 20 and left hand 22 as will become apparent hereinbelow. For the sake of exposition, mannequin 10 is shown in the form of a female figure, however, it can be readily appreciated that mannequin 10 can be in the form of a male figure, a cartoon character, etc. depending on the product being promoted.

Figure 3:
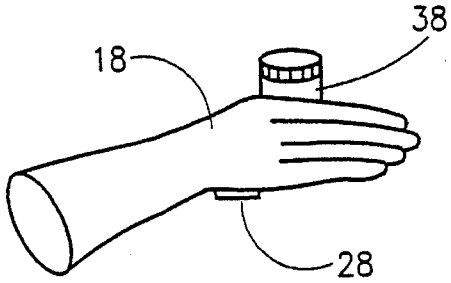
FIG. 3 is a close-up view of the dispensing arm of the sample dispenser of FIG. 1.

It is a particular feature of the present invention that one of appendages 16 and 20 is employed for dispensing a sample of a product being promoted by mannequin 10 while the other appendage is used as a user controlled actuator for initiating a dispensing action of mannequin 10. In this instance, right arm 16 is employed as the dispensing arm and therefore includes a dispenser 28 for dispensing a sample of the product. Dispenser 28 is preferably integrated with right hand 18 such that it is concealed from view as best seen in FIG. 3. Dispenser 28 is adapted to the type of product to be dispensed by mannequin 10. For example, dispenser 28 can be an atomizer for dispensing samples of perfumes, a spout for dispensing beverages, etc. In this case, left arm 20 is employed as the user controlled actuator arm and therefore includes an actuator 30 actuated by the hand of a consumer for indicating that he or she wants to sample the product being promoted by mannequin 10. Actuator 30 is preferably integrated with left hand 22 such that it is readily accessible. Actuator 30 can be a depressible pushbutton, an IR sensor, an ultra sound detector, and the like. Furthermore, an array of actuators 30 can be provided such that a consumer can select a sample from a number of products.

It is a particular feature of the present invention that right arm 16, being the dispensing arm, is selectively displaceable between a stand-by position and a dispensing position. In particular, right arm 16 includes an upper arm section 32 rigidly connected to trunk section 14 and a lower arm section 34 pivotally mounted at right elbow 36 such that it can be rotated with respect to arm section 34 between a substantially upright stand-by position shown in FIG. 1 to a substantially horizontal dispensing position shown in FIG. 2. Left arm 18 is typically rigidly connected to trunk section 14.

It should be noted that the height of dispenser 28 above actuator 30 when arm section 34 is deployed in its dispensing position is preferably varied to accommodate the type of product being promoted by mannequin 10. For example, in the case that mannequin 10 is dispensing samples of perfume, dispenser 28, in the form of an atomizer, preferably approaches actuator 30 until dispenser 28 substantially overlies actuator 30 such that the sample is dispensed on the back of the consumer's hand actuating actuator 30. While, in the case that mannequin 10 is dispensing samples of beverage, dispenser 28 preferably approaches actuator 30 such that it is deployed above actuator 30 such that dispenser 28, in the form of a spout, can fill a glass placed on actuator 30.

It is a further feature of mannequin 10 that one of hands 18 and 22 is preferably configured such that it can grip a storage container 38 of the product that mannequin 10 dispenses samples thereof such that storage container 38 is on display before the public, thereby inducing an awareness of the packaging of the product. In this case, as best seen in FIG. 3, preferably hand 18 is configured to grip storage container 38 such that dispenser 28 can be integrated with storage container 38 to further enhance the imitation of consumer, a sales assistant, a waitress and the like dispensing a sample of a product.

Product awareness can be further enhanced by providing mannequin 10 with a speech delivery capability, generally designated 40, such that mannequin 10 issues a sales pitch each time a sample of the product is dispensed. The sales pitch can be in the form of the name of the product, an advertising slogan, the price of the product, etc. Speech delivery capability 40 is preferably realized by a dedicated hardware component 42 (see FIG. 4) as known in the art and a loudspeaker 44 integrated with the mouth of mannequin 10. Speech delivery capability 40 can also be activated by a volume detector 41, for example, as employed in a burglar alarm system, detecting the presence of a consumer from afar.

Figure 4:
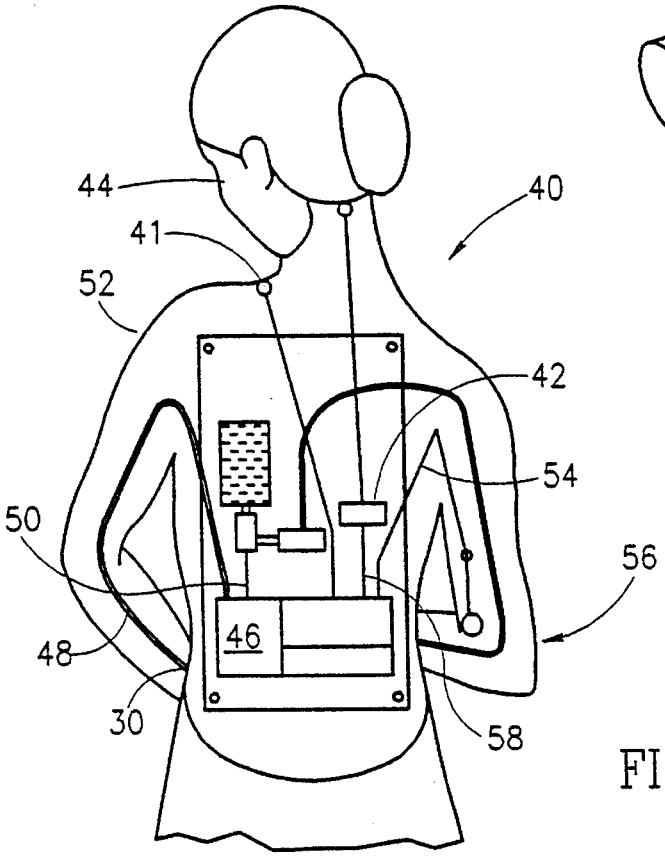
FIG. 4 is a schematic illustration of the control system of the sample dispenser of FIG. 1.

With reference now to FIG. 4, the schematic illustration depicts trunk section 14 housing a control system 46 controlling the operation of mannequin 10. Control system 46 receives an input signal along an input line 48 from actuator 30 when a consumer has indicated that he wants to receive a sample of the product being promoted by mannequin 10. In turn, control system 46 provides three output signals as follows: First, an output signal along line 50 to a sample delivery system, generally designated 52, for delivering a sample of the product. Second, an output signal along line 54 to a motorized driving mechanism, generally designated 56, described below with reference to FIGS. 6*a* and 6*b*, for driving lower arm 34 between its substantially upright stand-by position and its substantially horizontal dispensing position. And finally, an output signal along line 58 to speech deliver capability 40 for delivering a sales pitch associated with the product.

Figure 5:
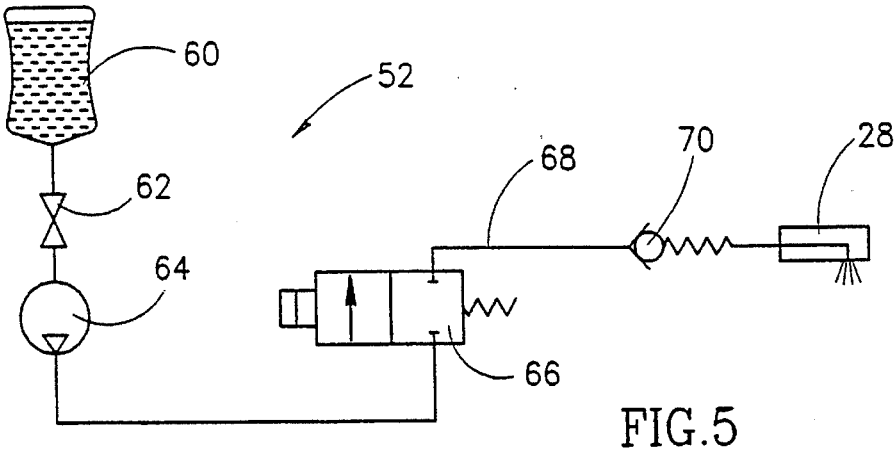
FIG. 5 is a schematic illustration of the sample delivery system of the sample dispenser of FIG. 1; and FIGS. **6*a* and 6*b* are side and front schematic illustrations of the driving mechanism of the sample dispenser of FIG. 1**.

With reference now to FIG. 5, the schematic illustration depicts sample delivery system 52 as including a collapsible drip bag 60, a gate valve 62, a pump 64, a solenoid valve 66, a supply line 68 extending along right arm 18 to a non-return valve 70 and atomizer 28. Other implementations of sample delivery system 52 can be equally realized.

Figure 6A:
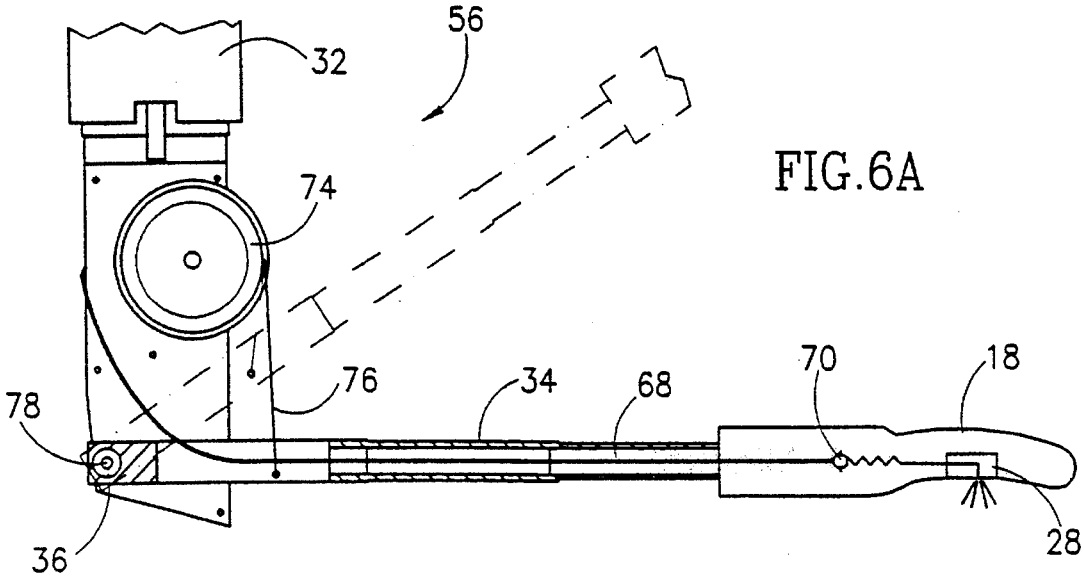
Figure 6B:
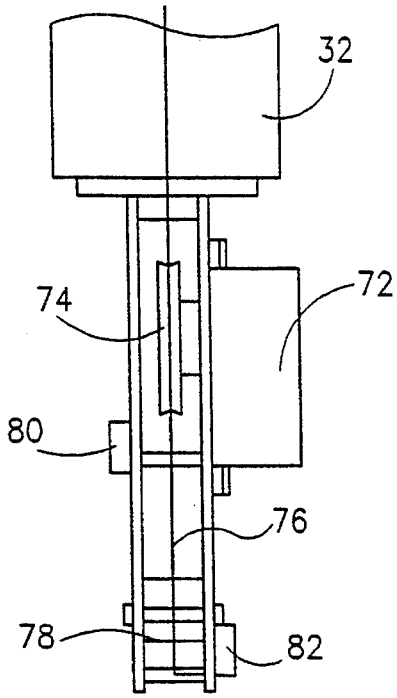

Turning now to FIGS. 6*a* and 6*b*, the schematic illustrations show a preferred implementation of driving mechanism 56 for driving lower arm 34 between a substantially upright stand-by position and a substantially horizontal dispensing position. Broadly speaking, driving mechanism 56 includes a motor 72, connected to line 54, for rotating a wheel 74 for releasing and taking up a cable 76 connected to lower arm 34 such that lower arm 34 can rotate about a pivot 78 at right elbow 36 between a substantially upright position and a substantially horizontal position. Upper and lower limit switches 80 and 82, respectively, are employed for determining the movement of lower arm 34. Upper limit switch indicates the stand-by position of lower arm 34 while lower limit switch indicates the dispensing position of lower arm 34.

The operation of mannequin 10 is as follows starting from an initial stand-by position for the dispensing of a sample of perfume. Hence, in this case, dispenser 28 is preferably in the form of an atomizer and the dispensing position of lower arm 34 is such that dispenser 28 substantially overlies actuator 30.

A consumer approaches mannequin 10 and actuates actuator 30 to indicate that he or she wishes to sample the product being promoted by mannequin 10. Actuator 30 transmits a signal to control system 46 which in turn transmits a signal to motor 72 for lowering lower arm 34 from its stand-by position to its dispensing position. Lower arm 34 activates limit switch 82 on arrival at its dispensing position for transmitting a signal to control system 46 that a sample can be dispensed. Control system 46 actuates pump 64 and transmits a signal to solenoid 66 causing a sample of product to be dispensed from dispenser 28 onto the back of the hand of the consumer actuating actuator 30. After a sample has been delivered, control system 46 disables pump 64 and solenoid 66 and transmits a signal to motor 72 for raising lower arm 34 from its substantially horizontal dispensing position to its substantially vertical stand-by position. Lower arm 34 activates limit switch 80 on arrival at its stand-by position for transmitting a signal to control system 46 that motor 72 can be disabled.

While the invention has been described with respect to a limited number of embodiments, it will be appreciated that many variations, modifications and other applications of the invention may be made.

What is claimed is:

1. A sample dispenser for dispensing a sample of a product, the sample dispenser comprising:

(a) dispensing means for dispensing the sample, said dispensing means displaceable between a first position, wherein said dispensing means is holding the sample, and a second position, wherein said dispensing means is dispensing the sample;

(b) motorized driving means for selectively driving said dispensing means between said first and second positions; and (c) user controlled activation means for actuating said motorized driving means, said dispensing means being deployed over said user controlled activation means when said dispensing means is in said second position.

2. The dispenser as in claim 1, wherein said dispensing means rotates between a substantially upright position and a substantially horizontal position.

3. The dispenser as in claim 1, wherein said user controlled activation means is a depressible device.

4. The dispenser as in claim 1, further comprising speech delivery means for delivering a sales pitch associated with the sample.

5. The dispenser as in claim 1, further comprising display means for displaying a storage container of the product.

6. The dispenser as in claim 1 configured as at least a portion of a mannequin.

7. A sample dispenser for dispensing a sample of a product, the sample dispenser comprising:

(a) dispensing means for dispensing the sample, said dispensing means displaceable between a first position, wherein said dispensing means is holding the sample, and a second position, wherein said dispensing means is dispensing the sample;

(b) motorized driving means for selectively driving said dispensing means between said first and second positions; and (c) user controlled activation means for actuating said motorized driving means, said dispensing means being substantially overlayed over said user controlled activation means when said dispensing means is in said second position.

8. The dispenser as in claim 7, wherein said dispensing means rotates between a substantially upright position and a substantially horizontal position.

9. The dispenser as in claim 7, wherein said user controlled activation means is a depressible device.

10. The dispenser as in claim 7, further comprising speech delivery means for delivering a sales pitch associated with the sample.

11. The dispenser as in claim 7, further comprising display means for displaying a storage container of the product.

12. The dispenser as in claim 7 configured as at least a portion of a mannequin.

13. A sample dispenser for dispensing a sample of a product, the sample dispenser comprising:

(a) dispensing means for dispensing the sample, said dispensing means displaceable between a first position, wherein said dispensing means is holding the sample, and a second position, wherein said dispensing means is dispensing the sample;

(b) motorized driving means for selectively driving said dispensing means between said first and second positions; and (c) user controlled activation means including a sensor for actuating said motorized driving means.

14. The dispenser as in claim 13, wherein said dispensing means rotates between a substantially upright position and a substantially horizontal position.

15. The dispenser as in claim 13, wherein said user controlled activation means is a depressible device.

16. The dispenser as in claim 13, further comprising speech delivery means for delivering a sales pitch associated with the sample.

17. The dispenser as in claim 13, further comprising display means for displaying a storage container of the product.

18. The dispenser as in claim 13 configured as at least a portion of a mannequin.

* * * * *